US008113919B2

(12) United States Patent
Shim

(10) Patent No.: US 8,113,919 B2
(45) Date of Patent: Feb. 14, 2012

(54) BOWLING BALL SURFACE TREATMENT APPARATUS

(76) Inventor: Sang-Bae Shim, Gyeonggi-do (KR)

( * ) Notice: Subject to any disclaimer, the term of this patent is extended or adjusted under 35 U.S.C. 154(b) by 924 days.

(21) Appl. No.: 12/131,687

(22) Filed: Jun. 2, 2008

(65) Prior Publication Data

US 2009/0298400 A1 Dec. 3, 2009

(51) Int. Cl.
*B24B 7/00* (2006.01)

(52) U.S. Cl. ..... 451/159; 451/267; 451/268; 451/271; 451/282; 451/283

(58) Field of Classification Search ..... 451/11, 451/49, 50, 158, 159, 267, 268, 269, 271, 451/282, 283; 15/21.2
See application file for complete search history.

(56) References Cited

U.S. PATENT DOCUMENTS

| | | | | | |
|---|---|---|---|---|---|
| 2,405,344 | A * | 8/1946 | Cloutier | 451/50 |
| 2,420,988 | A * | 5/1947 | Tholen | 15/97.1 |
| 2,479,898 | A * | 8/1949 | Beaudette | 15/93.1 |
| 3,106,133 | A * | 10/1963 | Arpaio, Jr. et al. | 409/178 |
| 3,341,982 | A * | 9/1967 | Torresen | 451/446 |
| 3,654,655 | A * | 4/1972 | Mitnick | 15/21.2 |
| 3,714,703 | A * | 2/1973 | Maples | 29/560 |
| 3,971,164 | A * | 7/1976 | Albin et al. | 451/283 |
| 5,484,329 | A * | 1/1996 | Engelbrektson | 451/523 |
| 5,613,896 | A * | 3/1997 | Haus et al. | 451/50 |
| 6,077,148 | A * | 6/2000 | Klein et al. | 451/11 |
| 6,186,875 | B1 * | 2/2001 | Cook et al. | 451/268 |
| 6,643,881 | B1 * | 11/2003 | Shim | 15/21.2 |
| 6,746,315 | B2 * | 6/2004 | Klukos | 451/50 |
| 7,585,203 | B1 * | 9/2009 | Shim | 451/5 |
| 7,892,073 | B1 * | 2/2011 | Smania et al. | 451/50 |
| 2002/0168925 | A1 * | 11/2002 | Klukos | 451/49 |
| 2003/0049996 | A1 * | 3/2003 | Nam | 451/178 |
| 2004/0171336 | A1 * | 9/2004 | Arai et al. | 451/177 |
| 2006/0111029 | A1 * | 5/2006 | Sim | 451/491 |

* cited by examiner

*Primary Examiner* — Eileen P. Morgan
(74) *Attorney, Agent, or Firm* — Patent Law Group LLP; Carmen C. Cook

(57) ABSTRACT

A bowling ball surface treatment apparatus is designed to uniformly abrade and polish a bowling ball. The apparatus includes a housing and a ball movement guider provided inside the housing for guiding movement of a bowling ball and confining the bowling ball within a limited surface treatment area, and a surface treatment disc arranged below the ball movement guider for supporting, rotating and revolving the bowling ball. The surface treatment disc has a disc shaft and a surface treatment element for abrading or polishing the bowling ball. The apparatus further includes a disc rotating device for rotating the surface treatment disc about a disc center axis and a disc revolving device for rotatably holding the disc shaft of the surface treatment disc and for causing the surface treatment disc to make revolving movement around a sun axis offset from the disc center axis.

17 Claims, 7 Drawing Sheets

BOWLING BALL SURFACE TREATMENT APPARATUS

FIELD OF THE INVENTION

The present invention pertains to a bowling ball surface treatment apparatus and, more specifically, to a bowling ball surface treatment apparatus capable of uniformly abrading and polishing a bowling ball while rotating the bowling ball in many different directions.

BACKGROUND OF THE INVENTION

Frictional rolling contact between a bowling ball and a lane often leaves irregular wear portions or scratches on a surface of the bowling ball. In particular, the bowling ball tends to make contact with the lane substantially at the same circumferential area thereof, which may cause unbalanced wear of the bowling ball. The scratched or unevenly worn bowling ball looks ugly and use of the scratched or unevenly worn bowling ball makes it difficult for a bowler to exercise, e.g., spin skills at his or her desire due mainly to the unpredictable movement of the bowling ball. As a result, the scratch and the unbalanced wear may adversely affect the score of a bowling game, thus reducing amusement of the game played. Thus, the bowling ball needs to be periodically abraded into a perfect spherical shape with no or little scratch.

There are a number of prior art references that disclose a device for automatically abrading a bowling ball. One of them is U.S. Pat. No. 5,613,896 that teaches a bowling ball resurfacing machine including three shafts disposed at an angle of 120 degrees in such a manner as to support a bowling ball, three motors for rotating the corresponding shafts in a forward or reverse direction, and three cone-shaped abrading cups mounted on the shafts. Although this bowling ball resurfacing machine has its own advantages, it suffers from a drawback in that a rolling direction or a rotation axis of the bowling ball cannot be vigorously changed during a resurfacing process. For this reason, the bowling ball resurfacing machine encounters a difficulty in uniformly abrading the whole surface of the bowling ball into a perfect sphere.

Another prior art reference is U.S. Pat. No. 7,063,607 disclosing a bowling ball resurfacing apparatus that includes a housing, first and second vertical support rollers mounted to the housing for rotation about parallel vertical axes, each of the vertical support rollers adapted to make contact with the surface of the bowling ball at one lateral bottom side of the bowling ball, first and second horizontal support rollers mounted to the housing for supporting the bowling ball in cooperation with the vertical support rollers, each of the horizontal support rollers rotatable about horizontal axes and adapted to make contact with the surface of the bowling ball at the other lateral bottom side of the bowling ball, drive motors for causing the support rollers to rotate, and a grinding-and-polishing wheel assembly for making frictional contact with the surface of the bowling ball to grind or polish the bowling ball.

The prior art devices noted above are capable of substantially evenly abrading or polishing the surface of the bowling ball by rotating the bowling ball in different directions. However, the prior art devices leave a room for improvement because they are structurally complicated, difficult and costly to fabricate, and highly susceptible to trouble.

SUMMARY OF THE INVENTION

In view of the above-mentioned or other problems inherent in the prior art devices, it is an object of the present invention to provide a bowling ball surface treatment apparatus capable of rotating a bowling ball in many different directions and uniformly abrading and polishing the whole surface of the bowling ball within a shortened period of time.

Another object of the invention is to provide a bowling ball surface treatment apparatus which is simple in structure, easy to manufacture and low in price.

In accordance with the present invention, there is provided a bowling ball surface treatment apparatus, comprising:

a housing;

a ball movement guider provided inside the housing for guiding movement of a bowling ball and confining the bowling ball within a limited surface treatment area, the ball movement guider having an inner surface formed of a curvilinear guide surface portion for guiding the bowling ball along a curved course of movement and a diverter portion for changing the course of movement of the bowling ball;

a surface treatment disc arranged below the ball movement guider for supporting, rotating and revolving the bowling ball, the surface treatment disc having a disc shaft and a surface treatment element for making frictional contact with the bowling ball to abrade or polish the bowling ball;

a disc rotating device for rotating the surface treatment disc about a disc center axis; and a disc revolving device for rotatably holding the disc shaft of the surface treatment disc and for causing the surface treatment disc to make revolving movement around a sun axis offset from the disc center axis.

With the bowling ball surface treatment apparatus of the present invention, it is possible to uniformly abrade and polish the whole surface of the bowling ball within a shortened period of time. Furthermore, the present bowling ball surface treatment apparatus has a simple structure and therefore can be manufactured in an easy and cost-effective manner.

BRIEF DESCRIPTION OF THE DRAWINGS

The above and other objects and features of the present invention will become apparent from the following description of preferred embodiments given in conjunction with the accompanying drawings, in which.

DESCRIPTION OF THE PREFERRED EMBODIMENTS

One preferred embodiment of a bowling ball surface treatment apparatus in accordance with the present invention will now be described in detail with reference to the accompanying drawings.

Figure 1:
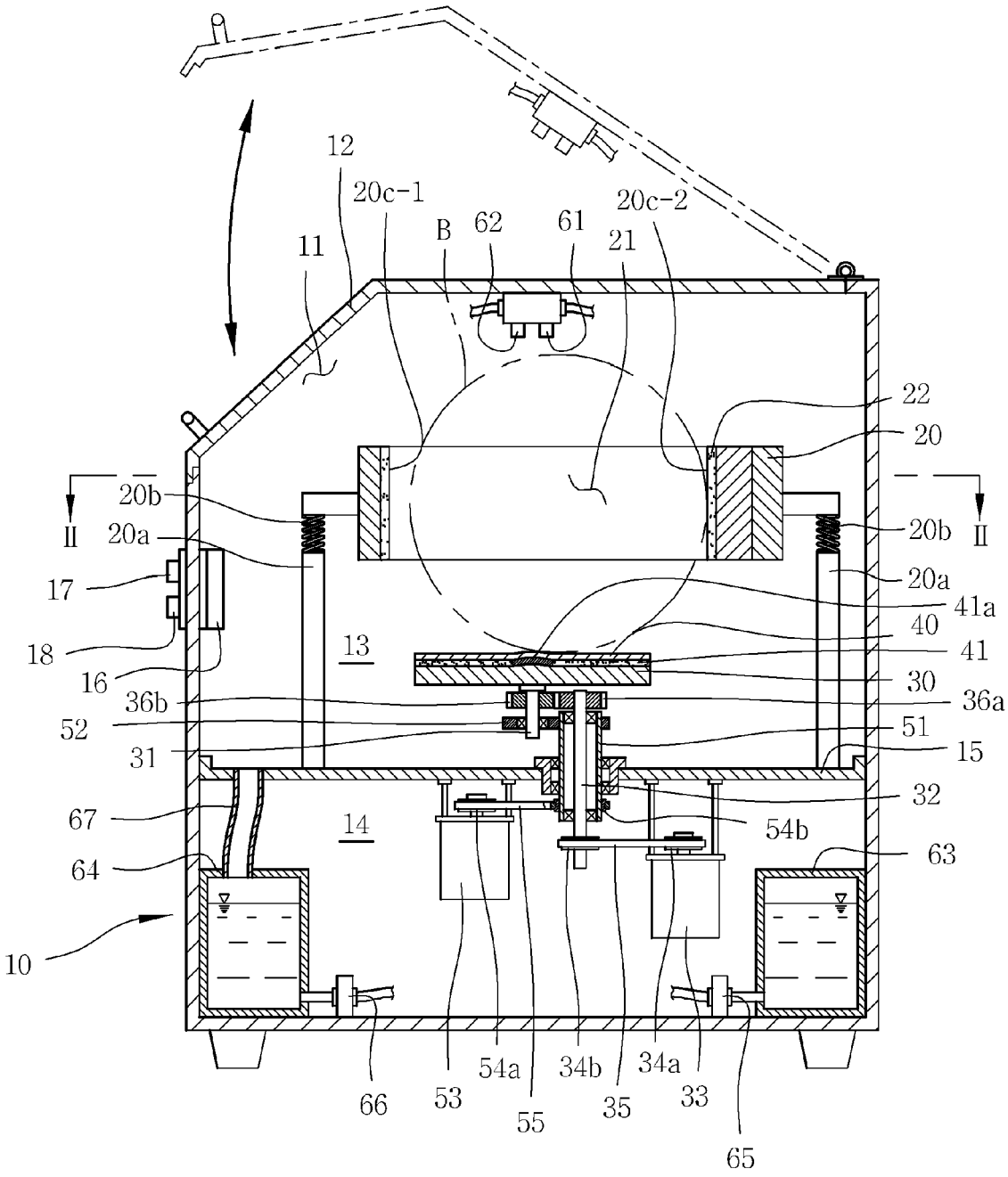
FIG. 1 is a side elevational section view showing a bowling ball surface treatment apparatus in accordance with the present invention.
Figure 2:
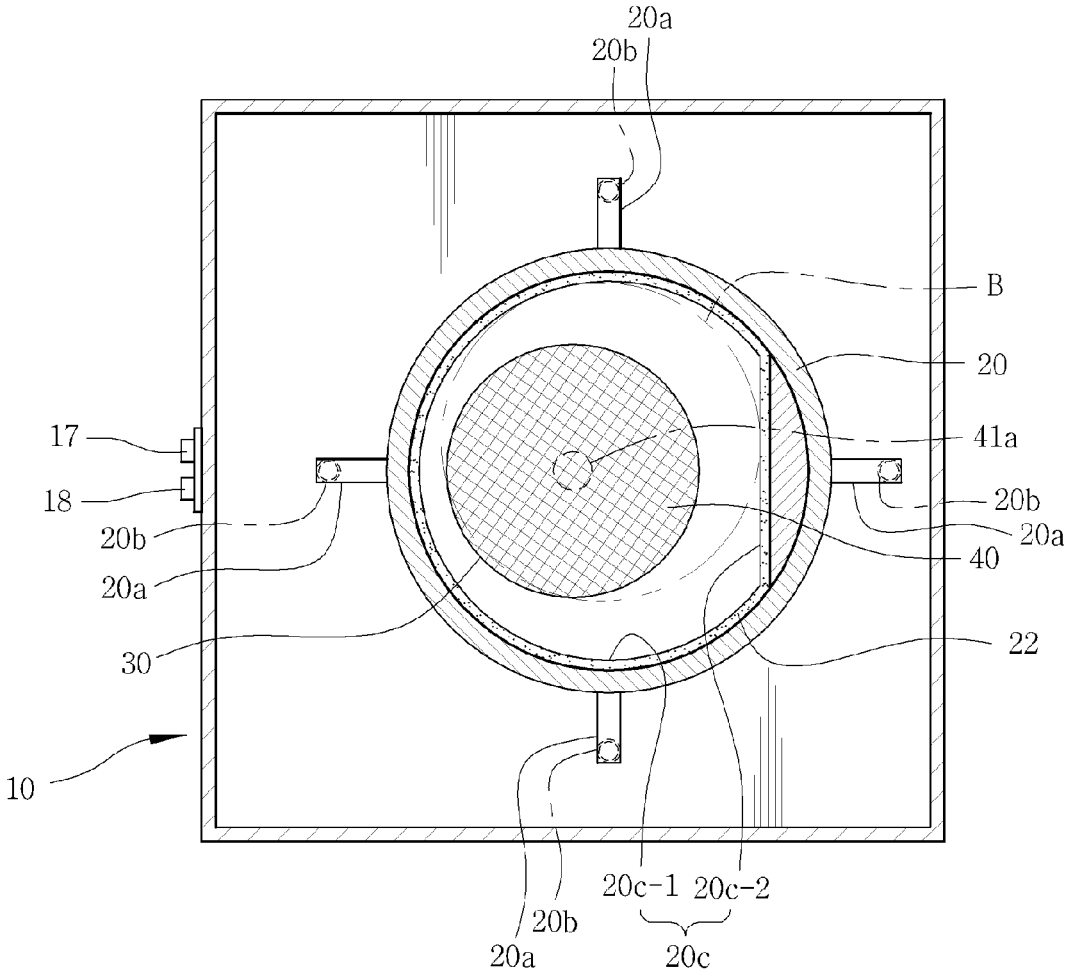
FIG. 2 is a cross sectional view of the bowling ball surface treatment apparatus taken along line II-II in FIG. 1.

Referring to FIGS. 1 and 2, a bowling ball surface treatment device includes a housing 10 having a top access opening 11 through which a bowling ball B is put into or taken out from the housing 10. The access opening 11 is openably closed by a lid 12. The housing 10 has an internal space divided into an upper surface treatment compartment 13 and a lower drive compartment 14 by means of a partition plate 15. In the surface treatment compartment 13, the bowling ball B inserted through the access opening 11 is subjected to surface treatments. The drive compartment 14 is designed to receive various drive units described later.

A control board 16 for controlling the operation of the bowling ball surface treatment apparatus is attached to an internal side surface of the housing 10. A series of push buttons 17 and a timer 18 for setting various operating conditions of the bowling ball surface treatment apparatus are arranged on an external side surface of the housing 10 and electrically associated with the control board 16.

Within the surface treatment compartment 13 of the housing 10, there is provided a generally ring-shaped ball movement guider 20 for guiding the movement of the bowling ball B and confining the bowling ball B within a limited surface treatment area. Although the ball movement guider 20 has a generally circular shape in the illustrated embodiment, it may have an elliptical shape, a polygonal shape or other irregular shape.

In the illustrated embodiment, the ball movement guider 20 is fixedly secured to the partition plate 15 by means of a plurality of rod-like support members 20*a* extending downwardly from the ball movement guider 20. Each of the support members 20*a* is provided with a coil spring portion 20*b* that serves to reduce vibration and noise which would be generated in the ball movement guider 20 during operation of the bowling ball surface treatment apparatus. Alternatively, the ball movement guider 20 may be attached to the housing 10 through a shock-absorber, e.g., a coil spring. Although four support members 20*a* are used in the illustrated embodiment, the number of the support members 20*a* may be greater or lesser.

The ball movement guider 20 has a ball reception opening 21 for rotatably and revolvably receiving the bowling ball B and an inner surface 20*c* along which the bowling ball B makes revolving movement. The ball reception opening 21 is somewhat greater in diameter than the bowling ball B to ensure that the bowling ball B received in the ball reception opening 21 can freely revolve along the inner surface 20*c* of the ball movement guider 20 while rotating about its own axis. A shock-absorbing liner 22 made of an elastically deformable material, e.g., a rubber strip, is detachably attached to the inner surface 20*c* of the ball movement guider 20.

The inner surface 20*c* of the ball movement guider 20 includes a curvilinear guide surface portion 20*c*-1 for guiding the revolving movement of the bowling ball B along a curved course of movement and a diverter surface portion 20*c*-2 for changing the course of movement of the bowling ball B when the bowling ball B makes revolving movement about the center axis of the ball movement guider 20. As best shown in FIG. 2, the curvilinear guide surface portion 20*c*-1 extends over about two thirds of the inner surface 20*c* and the diverter portion 20*c*-2 is formed into a generally planar surface shape and designed to interconnect the opposite ends of the curvilinear guide surface portion 20*c*-1. It is preferred that the diverter portion 20*c*-2 is arranged in the rear extension of the ball movement guider 20. This assists in taking out the bowling ball B when the surface treatments are completed. The length of the curvilinear guide surface portion 20*c*-1 and the diverter portion 20*c*-2 is not limited to the one illustrated in FIG. 2 but may be arbitrarily changed if such a need arise. Although the diverter portion 20*c*-2 has a planar surface shape in the illustrated embodiment, it may be formed into, e.g., a bulged surface shape, a slightly concave surface shape or other shapes. If necessary, an additional diverter portion may be formed in a symmetrical relationship with the diverter portion 20*c*-2. In a nutshell, the diverter portion 20*c*-2 may be modified in its shape and number as long as the diverter portion 20*c*-2 can positively change the course of movement of the bowling ball B.

A surface treatment disc 30 is arranged below the ball movement guider 20 to support, rotate and revolve the bowling ball B. The surface treatment disc 30 is provided with a disc shaft 31 extending downwardly along a disc center axis. The surface treatment disc 30 has a surface treatment element that makes frictional contact with the bowling ball B to perform surface treatments, i.e., abrading and/or polishing. In the illustrated embodiment, the surface treatment element is formed of a surface treatment fabric 40 and a cushion backing 41 attached to the surface treatment fabric 40.

Examples of the surface treatment fabric 40 include an abrading fabric such as a sheet of sandpaper or a sheet of diamond-coated paper and a polishing fabric such as a non-woven fabric or cotton fabric. The abrading fabric and the polishing fabric can be selectively used in abrading and polishing the bowling ball B. It is preferred that three kinds of abrading fabrics, i.e., fine, medium and coarse abrading fabrics, are used to abrade the bowling ball B with different roughness.

The cushion backing 41 is made of, e.g., a sponge material, which absorbs shock generated by the bowling ball B during a surface treatment process. The shock-cushion backing 41 is replaceably attached to the top surface of the surface treatment disc 30 by means of, e.g., a Velcro fastener. The cushion backing 41 has a central hard portion 41*a* whose hardness is greater than that of the remaining portion of the cushion backing 41. The central hard portion 41*a* serves to cause a slip between the bowling ball B and the surface treatment fabric 40 when the bowling ball B is moved radially inwardly and brought into contact with the surface treatment fabric 40 in a position just above the central hard portion 41*a* of the cushion backing 41. This helps to prevent the bowling ball B from rotating at an exceptionally high speed during the surface treatment process. In order to reliably generate the slip between the bowling ball B and the surface treatment fabric 40 in the position just above the central hard portion 41*a* of the cushion backing 41, the surface treatment disc 30 is formed to have a central convex region corresponding to the central hard portion 41*a* of the cushion backing 41.

The bowling ball surface treatment apparatus includes a disc rotating device for rotating the surface treatment disc 30 and the disc shaft 31 about the disc center axis and a disc revolving device for causing the surface treatment disc 30 to revolve, or make planetary movement, around a sun axis offset a predetermined distance from the disc center axis.

The disc rotating device includes a disc driving shaft 32 extending through the partition plate 15 into the surface treatment compartment 13 and the drive compartment 14, a disc driving motor 33 provided within the drive compartment 14, a pair of pulleys 34*a* and 34*b* and a belt 35 for transferring a torque of the disc driving motor 33 to the disc driving shaft 32, and a pair of spur gears 36*a* and 36*b* for transferring a torque of the disc driving shaft 32 to the disc shaft 31 of the surface treatment disc 30.

On the other hand, the disc revolving device includes a sun shaft 51 mounted for rotation about the sun axis. The sun shaft 51 or the sun axis is also offset from a vertical center axis of the ball movement guider 20 to ensure that, during a below-mentioned surface treatment process, the bowling ball B can make contact with the surface treatment fabric 40 in different radial positions of the surface treatment disc 30. The sun shaft 51 or the sun axis is arranged nearer to the diverter portion

20*c*-2 than to the curvilinear guide surface portion 20*c*-1. The sun shaft 51 is of a hollow type extending through the partition plate 15 into the drive compartment 14 and is rotatably supported on the partition plate 15.

Figure 3:
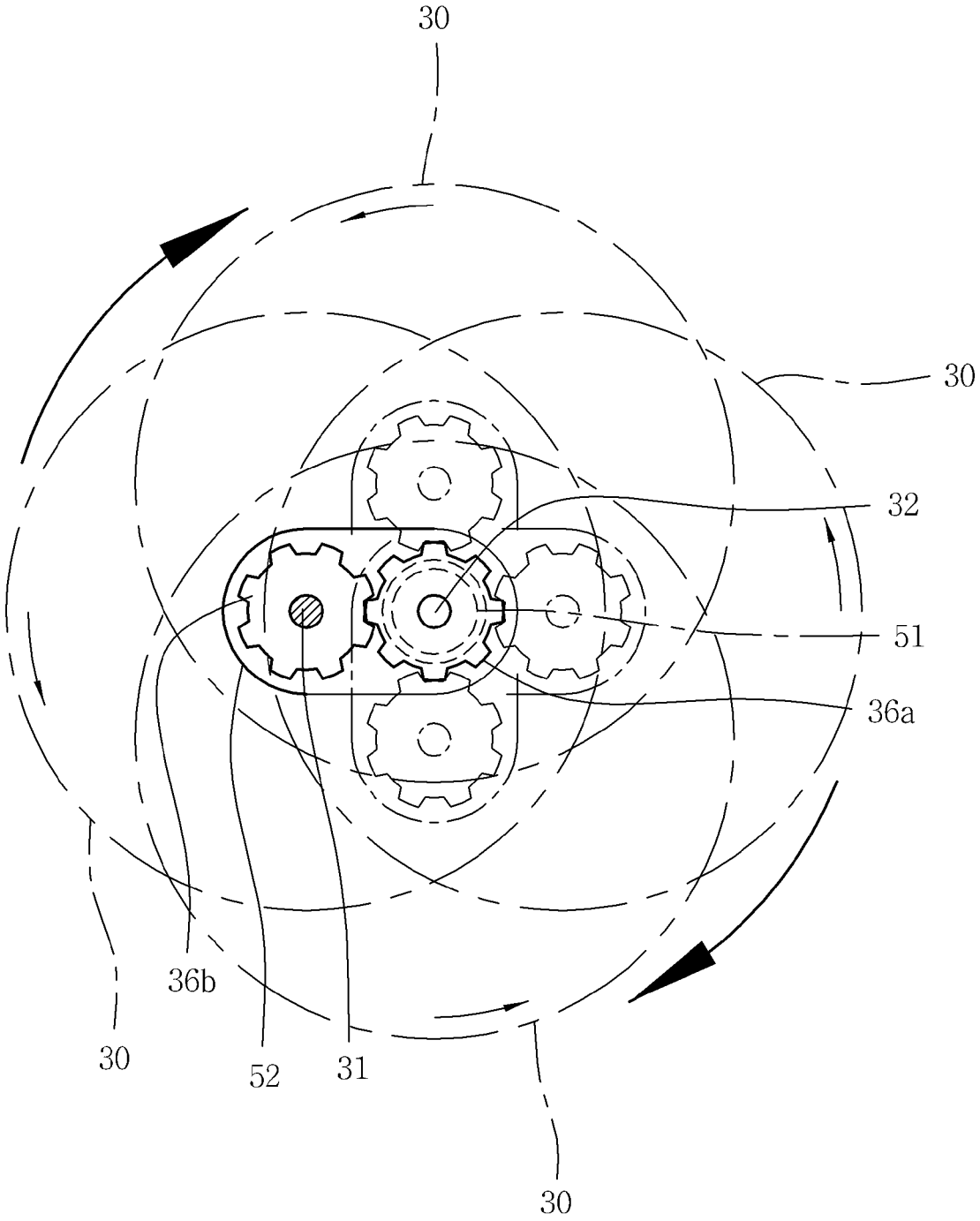
FIG. 3 is a view illustrating the movement of a disc revolving device employed in the bowling ball surface treatment apparatus of the present invention.

The disc revolving device further includes a carrier arm 52 fixedly secured to the sun shaft 51 at its proximal end. The carrier arm 52 is designed to rotatably support the disc shaft 31 of the surface treatment disc 30 at its distal end, with a specified interval left between the sun shaft 51 and the disc shaft 31. The sun shaft 51 is rotatingly driven by a sun shaft driving device. If the sun shaft 51 is rotated as illustrated in FIG. 3, the surface treatment disc 30 revolves clockwise around the sun shaft 51 while rotating counterclockwise about the disc center axis. In this regard, it is preferred that the rotating direction of the surface treatment disc 30 is opposite to the revolving direction thereof. By the revolving movement of the surface treatment disc 30, the bowling ball B is also revolved around the center axis of the ball movement guider 20 and is moved along the inner surface 20*c* of the ball movement guider 20. As will be fully described below with reference to FIGS. 4 to 11, the bowling ball B is moved along the curvilinear guide surface portion 20*c*-1 at a relatively low revolving speed but is moved fast along the diverter portion 20*c*-2. Furthermore, the revolving movement of the bowling ball B is stopped for a while when the bowling ball B makes initial contact with the diverter portion 20*c*-2.

The sun shaft driving device includes a sun shaft driving motor 53 provided within the drive compartment 14. The sun shaft driving device further includes a pair of pulleys 54*a* and 45*b* and a belt 55 for transferring a torque of the sun shaft driving motor 53 to the sun shaft 51.

During a surface treatment process, the surface treatment disc 30 is rotated about the disc center axis by means of the disc rotating device and, at the same time, is caused to make revolving or planetary movement around the sun axis, i.e., the sun shaft 51, by means of the disc revolving device, whereby the bowling ball B can make frictional contact with the surface treatment fabric 40 in different radial positions of the surface treatment disc 30.

At this time, the operations of the disc driving motor 33 and the sun shaft driving motor 53 are controlled by the control board 16. Using the push buttons 17 and the timer 18, the surface treatment disc 30 is set to rotate at a rotational speed of, e.g., 400 to 1200 rpm, and also to make revolving or planetary movement at a speed of, e.g., one revolution per one or two second. If necessary, the operation of the disc driving motor 33 may be intermittently stopped for a time period of, e.g., 1 to 3 second.

The bowling ball surface treatment apparatus includes a treatment solution supplying device for supplying surface treatment solutions to the bowling ball B. Two kinds of surface treatment solutions are used in the bowling ball surface treatment apparatus. One is an abrading solution for use in abrading the bowling ball B and the other is a polishing solution for use in polishing the bowling ball B.

The treatment solution supplying device includes an abrading solution injection nozzle 61 for injecting the abrading solution to the surface of the bowling ball B, a polishing solution injection nozzle 62 for injecting the polishing solution to the surface of the bowling ball B, an abrading solution tank 63 for storing the abrading solution, a polishing solution tank 64 for storing the polishing solution, an abrading solution pump 65 for pumping the abrading solution stored in the abrading solution tank 63 to the abrading solution injection nozzle 61, and a polishing solution pump 66 for pumping the polishing solution stored in the polishing solution tank 64 to the polishing solution injection nozzle 62.

The abrading solution injection nozzle 61 and the polishing solution injection nozzle 62 are attached to the inner side of the lid 12 so that they can face the bowling ball B received within the surface treatment compartment 13. The abrading solution tank 63, the polishing solution tank 64, the abrading solution pump 65 and the polishing solution pump 66 are arranged within the drive compartment 14. The polishing solution tank 64 communicates with the surface treatment compartment 13 through a drain pipe 67 to collect the abrading solution and the polishing solution injected into the surface treatment compartment 13.

Description will now be made on the operation of the bowling ball surface treatment apparatus configured as above.

First, the lid 12 is opened and the bowling ball B is placed on the surface treatment disc 30 through the ball reception opening 21 of the ball movement guider 20, as indicated by a single-dotted chain line in FIGS. 1 and 2.

Then, the operating conditions of the bowling ball surface treatment apparatus are set using the push buttons 17 and the timer 18. The disc driving motor 33 and the sun shaft driving motor 53 are energized and rotatingly driven under the control of the control board 16. The torque of the disc driving motor 33 is transferred to the disc driving shaft 32 via the pair of pulleys 34*a* and 34*b* and the belt 35, and then to the disc shaft 31 via the pair of spur gears 36*a* and 36*b*, thereby rotating the surface treatment disc 30 together with the disc shaft 31. Simultaneously, the torque of the sun shaft driving motor 53 is transferred to the sun shaft 51 via the pair of pulleys 54*a* and 54*b* and the belt 55. As the sun shaft 51 is rotated about the sun axis together with the carrier arm 52, the surface treatment disc 30 makes revolving or planetary movement around the sun shaft 51 or the sun axis as illustrated in FIG. 3.

Consequently, the bowling ball B is surface-treated by making frictional contact with the surface treatment fabric 40 attached to the surface treatment disc 30. As the surface treatment disc 30 continues to revolve around the sun shaft 51 offset from the center axis of the ball movement guider 20, the bowling ball B is brought into contact with different radial positions of the surface treatment disc 30. By the revolving movement of the surface treatment disc 30, the bowling ball B is also revolved around the center axis of the ball movement guider 20 and is moved along the inner surface 20*c* of the ball movement guider 20. In other words, the bowling ball B is moved along the curvilinear guide surface portion 20*c*-1 at a relatively low revolving speed but is rectilinearly moved along the diverter portion 20*c*-2 at a relatively high speed. The revolving movement of the bowling ball B is stopped for a while when the bowling ball B makes initial contact with the diverter portion 20*c*-2. The rotational axis about which the bowling ball B rotates is positively changed in this process, thus ensuring that the different surface regions of the bowling ball B make contact the surface treatment fabric 40 of the surface treatment disc 30 as the surface treatment apparatus continues to work. This makes it possible to uniformly abraded or polish the whole surface of the bowling ball B.

The revolving or planetary movement of the bowling ball B made within the ball movement guider 20 will be described in detail with reference to FIGS. 4 to 11.

Figure 4:
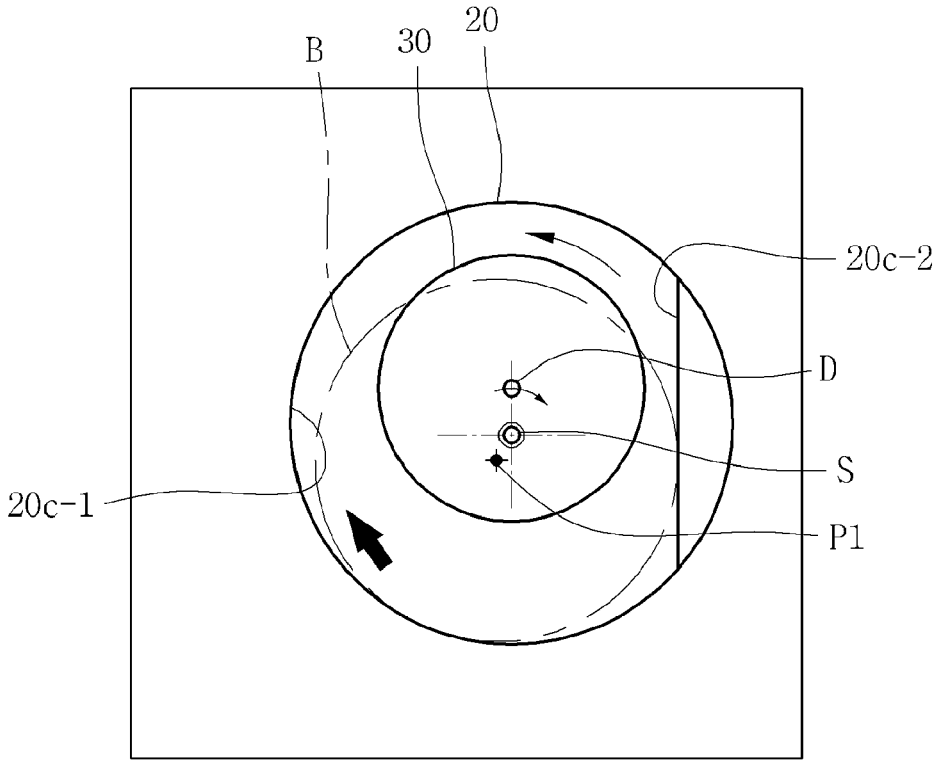
FIGS. 4 through 11 are schematic diagrams depicting the movement of a bowling ball during a surface treatment process performed by the bowling ball surface treatment apparatus of the present invention.

Referring first to FIG. 4, the surface treatment disc 30 is revolved clockwise around a sun axis S while rotating counterclockwise about a disc center axis D. The bowling ball B is moved from the 7 o'clock position toward the 9 o'clock position along the curvilinear guide surface portion 20*c*-1 of the inner surface 20*c* of the ball movement guider 20 at a relatively low speed. In the 7 o'clock position, the bowling ball B makes contact with the surface treatment disc 30 at a contact point P1. Since the distance between the disc center axis D and the contact point P1 is relatively great, the bowling ball B is rotated with an increased spinning force by means of the surface treatment disc 30. While revolving and rotating in this manner, the bowling ball B is abraded or polished by the surface treatment fabric 40 of the surface treatment disc 30.

Figure 5:
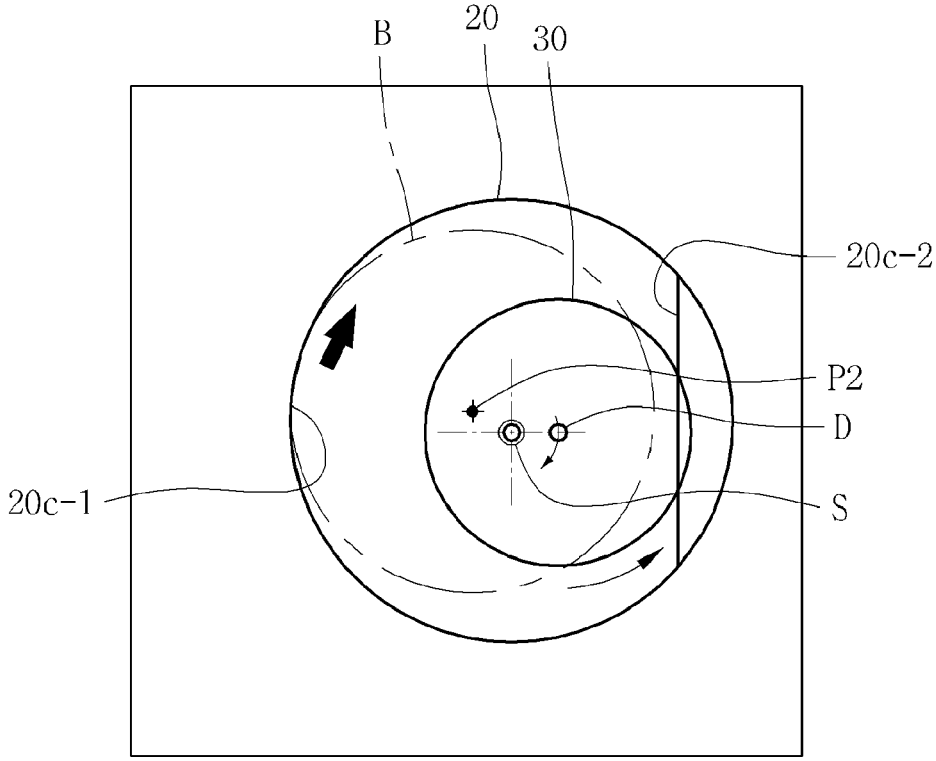

Turning to FIG. 5, the surface treatment disc 30 is further revolved clockwise around the sun axis S while rotating counterclockwise about the disc center axis D. Thus, the bowling ball B is moved from the 9 o'clock position toward the 11 o'clock position along the curvilinear guide surface portion 20*c*-1 of the inner surface 20*c* of the ball movement guider 20. In the 9 o'clock position, the bowling ball B makes contact with the surface treatment disc 30 at a contact point P2. Since the distance between the disc center axis D and the contact point P2 is relatively great, the bowling ball B is rotated with an increased spinning force by means of the surface treatment disc 30. While revolving and rotating in this manner, the bowling ball B is abraded or polished by the surface treatment fabric 40 of the surface treatment disc 30.

Figure 6:
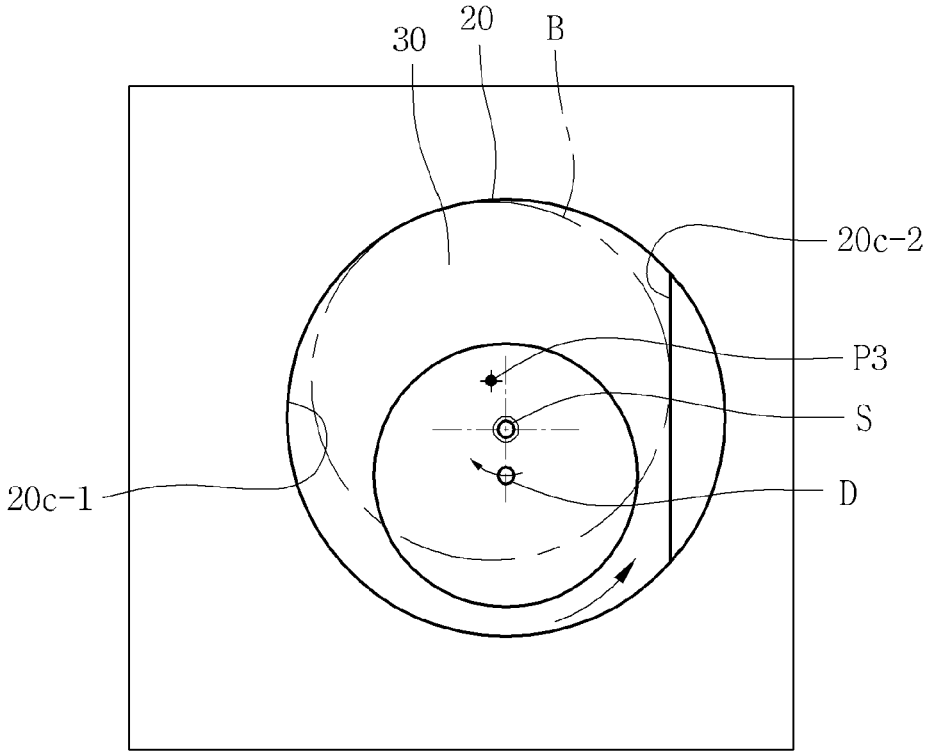

Turning to FIG. 6, the surface treatment disc 30 is further revolved clockwise around the sun axis S while rotating counterclockwise about the disc center axis D. At this time, the bowling ball B is pressed against the diverter portion 20*c*-2 of the inner surface 20*c* of the ball movement guider 20. In this state, the bowling ball B is kept stationary in the 11 o'clock position while making rotation about the disc center axis D. In the 11 o'clock position, the bowling ball B makes contact with the surface treatment disc 30 at a contact point P3. Since the distance between the disc center axis D and the contact point P3 is relatively great, the bowling ball B is rotated with an increased spinning force by means of the surface treatment disc 30. While rotating in the 11 o'clock position, the bowling ball B is abraded or polished by the surface treatment fabric 40 of the surface treatment disc 30.

Figure 7:
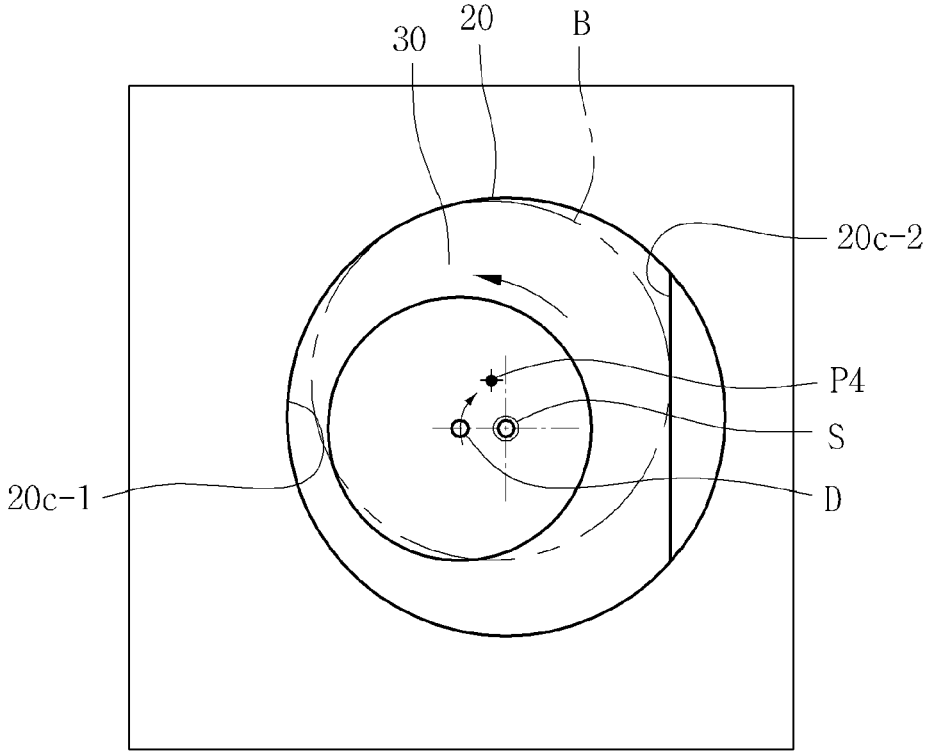

Turning to FIG. 7, the surface treatment disc 30 is further revolved clockwise around the sun axis S while rotating counterclockwise about the disc center axis D. The bowling ball B continues to be pressed against the diverter portion 20*c*-2 of the inner surface 20*c* of the ball movement guider 20. In this state, the bowling ball B is still kept stationary in the 11 o'clock position while making rotation about the disc center axis D. At this time, the bowling ball B makes contact with the surface treatment disc 30 at a contact point P4. Since the contact point P4 is moved radially inwardly of the surface treatment disc 30 from the contact point P3 shown in FIG. 6, the bowling ball B is rotated with a reduced spinning force by means of the surface treatment disc 30. While rotating in the 11 o'clock position, the bowling ball B is abraded or polished by the surface treatment fabric 40 of the surface treatment disc 30.

Figure 8:
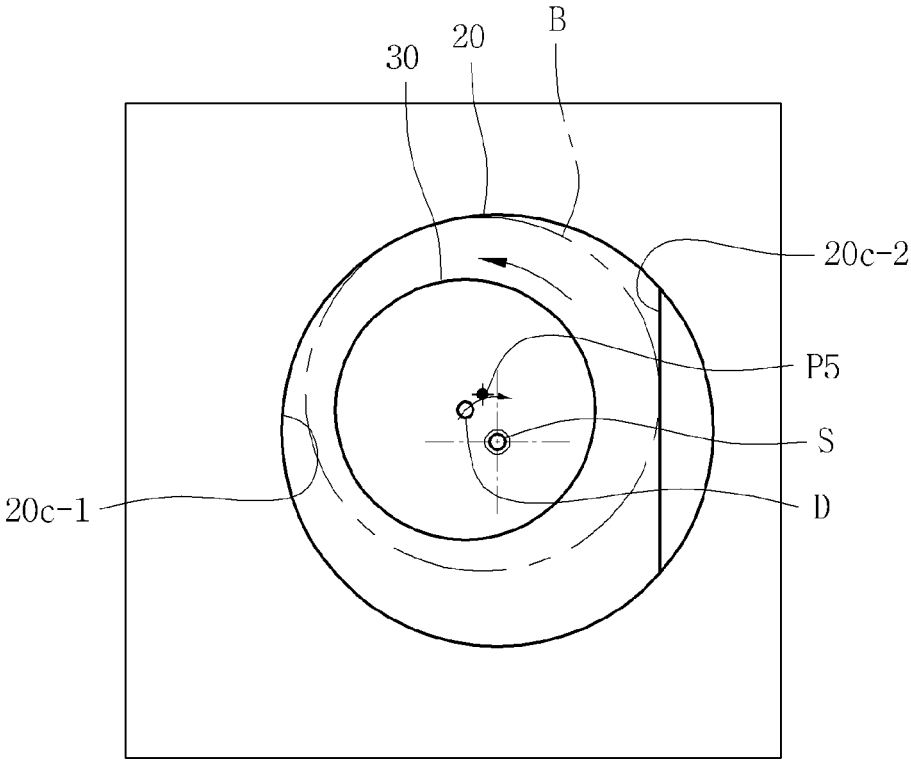

Turning to FIG. 8, the surface treatment disc 30 is even further revolved clockwise around the sun axis S while rotating counterclockwise about the disc center axis D. The bowling ball B continues to be pressed against the diverter portion 20*c*-2 of the inner surface 20*c* of the ball movement guider 20. In this state, the bowling ball B is still kept stationary in the 11 o'clock position while making rotation about the disc center axis D. At this time, the bowling ball B makes contact with the surface treatment fabric 40 just above the central hard portion 41*a* (see FIGS. 1 and 2) of the cushion backing 41 of the surface treatment disc 30 at a contact point P5 which lies radially inwardly of the surface treatment disc 30 from the contact point P4 shown in FIG. 7. Therefore, the spinning force of the surface treatment disc 30 applied to the bowling ball B is reduced to a great extent, thereby decelerating the rotation of the bowling ball B. This helps to prevent the bowling ball B from rotating at an uncontrollably high speed.

Figure 9:
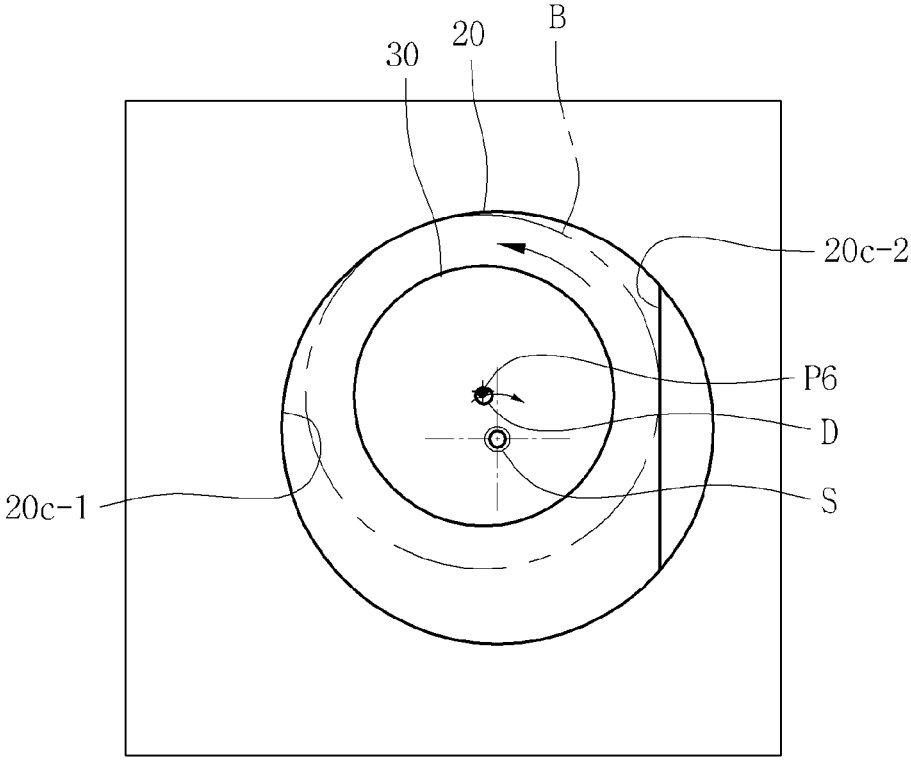

Turning to FIG. 9, the surface treatment disc 30 is even still further revolved clockwise around the sun axis S while rotating counterclockwise about the disc center axis D. The bowling ball B continues to be pressed against the diverter portion 20*c*-2 of the inner surface 20*c* of the ball movement guider 20. In this state, the bowling ball B is still kept stationary in the 11 o'clock position while making rotation about the disc center axis D. At this time, the bowling ball B makes contact with the surface treatment fabric 40 just above the central hard portion 41*a* (see FIGS. 1 and 2) of the cushion backing 41 of the surface treatment disc 30 at a contact point P6 which nearly coincides with the disc center axis D. Therefore, the spinning force of the surface treatment disc 30 applied to the bowling ball B is kept very small, thereby further decelerating the rotation of the bowling ball B. This helps to prevent the bowling ball B from rotating at an uncontrollably high speed.

Figure 10:
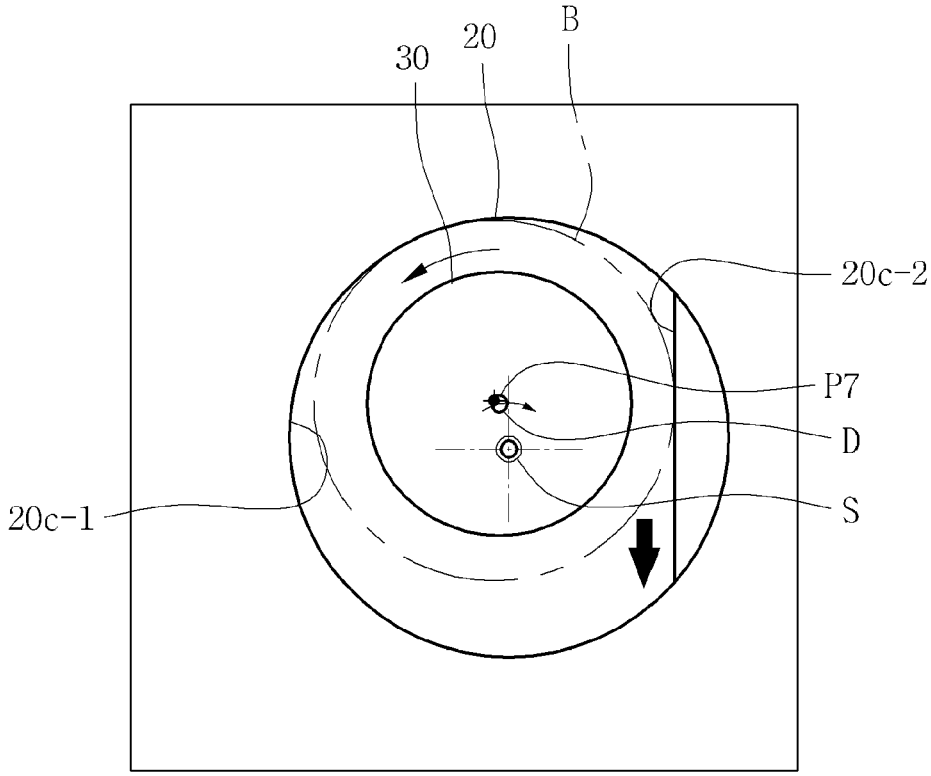
Figure 11:
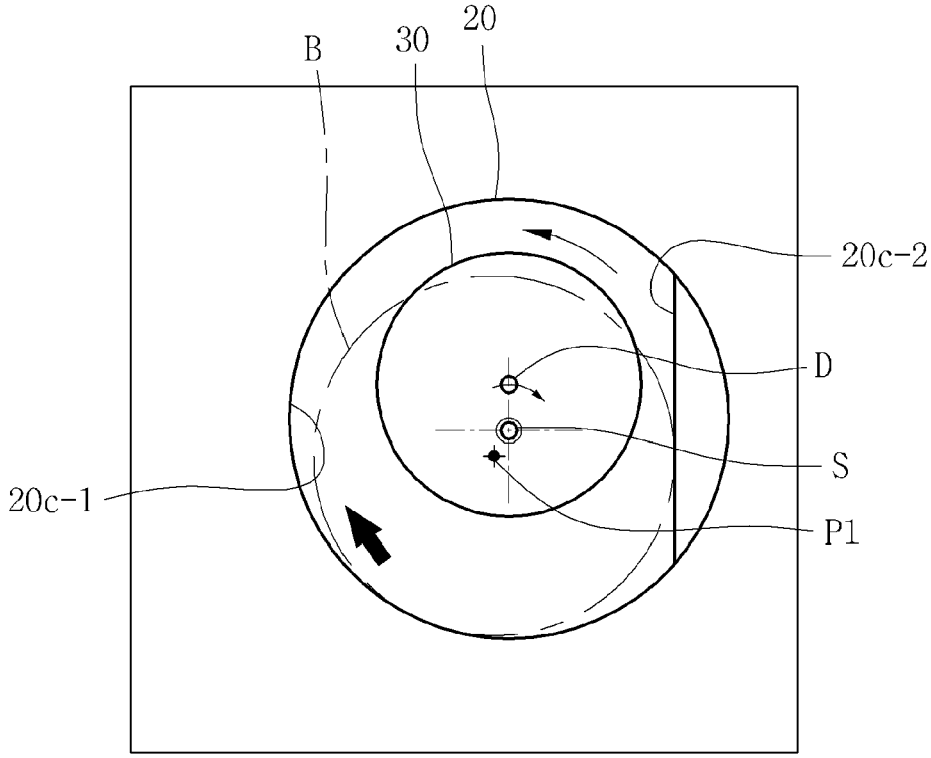

Turning to FIG. 10, the surface treatment disc 30 is even still further revolved clockwise around the sun axis S while rotating counterclockwise about the disc center axis D. Consequently, the bowling ball B makes contact with the surface treatment fabric 40 just above the central hard portion 41*a* (see FIGS. 1 and 2) of the cushion backing 41 of the surface treatment disc 30 at a contact point P7 which is slightly moved to the left from the disc center axis D. At this moment, the bowling ball B is escaped from the 11 o'clock position and is rapidly and rectilinearly moved along the diverter portion 20*c*-2 toward the 7 o'clock position shown in FIG. 11 (and in FIG. 4). The abrading or polishing region on the surface of the bowling ball B is positively changed by this rectilinear movement. This means that the abrading or polishing region of the bowling ball B is changed each time the surface treatment disc 30 makes one revolving or planetary movement around the sun axis S. Therefore, the whole surface of the bowling ball B is uniformly abraded or polished by the surface treatment fabric 40 of the surface treatment disc 30 as the surface treatment disc 30 continues to make revolving or planetary movement.

The surface treatments available in the bowling ball surface treatment apparatus are divided into an abrading process and a polishing process, which may be performed independently or in combination.

During the abrading process, an abrading fabric that constitutes the surface treatment fabric 40 is replaceably attached to the surface treatment disc 30. Coarse, medium and fine abrading fabrics may be selectively used to abrade the bowling ball B with different roughness. If needed, coarse abrading, medium abrading and fine abrading can be successively performed by attaching the coarse, medium and fine abrading fabrics to the surface treatment disc 30 one after another. In the abrading process, the abrading solution stored in the abrading solution tank 63 is supplied by the abrading solution pump 65 to the surface of the bowling ball B through the abrading solution injection nozzle 61.

During the polishing process, the abrading fabric is replaced by a polishing fabric that constitutes the surface treatment fabric 40. The polishing solution stored in the polishing solution tank 64 is supplied by the polishing solution pump 66 to the surface of the bowling ball B through the polishing solution injection nozzle 62.

While a preferred embodiment of the invention has been shown and described hereinabove, it will be understood by those skilled in the art that various changes and modifications may be made without departing from the spirit and scope of the invention as defined in the following claims.

What is claimed is:

1. A bowling ball surface treatment apparatus, comprising:

a housing;

a ring-shaped ball movement guider provided inside the housing for guiding movement of a bowling ball and confining the bowling ball within a limited surface treatment area, the ball movement guider having a ball reception opening having a diameter greater than a diameter of the bowling ball, the ball movement guider having an inner surface formed of a curvilinear guide surface portion for guiding the bowling ball along a curved course of movement and a diverter portion for changing the course of movement of the bowling ball;

a surface treatment disc arranged below the ball movement guider for supporting, rotating and revolving the bowling ball, the surface treatment disc having a disc shaft and a surface treatment element for making frictional contact with the bowling ball to abrade or polish the bowling ball;

a disc rotating device for rotating the surface treatment disc about a disc center axis; and a disc revolving device for rotatably holding the disc shaft of the surface treatment disc and for causing the surface treatment disc to make revolving movement around a sun axis offset from the disc center axis and also being offset from a vertical center axis of the ball movement guider;

wherein when the surface treatment disc rotates and makes revolving movement around the sun axis as caused by the disc rotating device and the disc revolving device, the surface treatment disc rotates and revolve the bowling ball supported thereon, the movement of the bowling ball being further confined and changed by the ball movement guider so that the bowling ball makes frictional contact with the surface treatment element to abrade or polish the bowling ball.

2. The bowling ball surface treatment apparatus as recited in claim 1, wherein the sun axis is arranged nearer to the diverter portion than to the curvilinear guide surface portion.

3. The bowling ball surface treatment apparatus as recited in claim 1, wherein the diverter portion is of a generally planar shape.

4. The bowling ball surface treatment apparatus as recited in claim 1, wherein the surface treatment element is formed of a surface treatment fabric and a cushion backing attached to the surface treatment fabric, the cushion backing having a central hard portion harder than the remaining portion of the cushion backing.

5. The bowling ball surface treatment apparatus as recited in claim 1, wherein the housing has an internal space divided into an upper surface treatment compartment and a lower drive compartment by means of a partition plate, the ball movement guider including a plurality of support members fixedly secured to the partition plate, each of the support members having a coil spring portion.

6. The bowling ball surface treatment apparatus as recited in claim 1, wherein the disc revolving device comprises a sun shaft rotatably mounted to the housing for rotation about the sun axis, a carrier arm attached to the sun shaft for rotatably supporting the disc shaft in a spaced-apart relationship with the sun shaft, and a driving mechanism for rotating the sun shaft to cause the revolving movement of the surface treatment disc.

7. The bowling ball surface treatment apparatus as recited in claim 1, wherein the revolving movement of the surface treatment disc causes the bowling ball to revolve around the vertical axis of the ball movement guider, the bowling ball being temporarily kept stationary when the bowling ball is pressed against the diverter portion of the ball movement guider.

8. The bowling ball surface treatment apparatus as recited in claim 1, wherein the bowling ball is rotated at increased or reduced spinning force as a result of the movements of the surface treatment disc and the movement of the bowling ball as confined and changed by the ball movement guider to cause the bowling ball makes frictional contact with the surface treatment element to abrade or polish the bowling ball.

9. A bowling ball surface treatment apparatus, comprising:

a housing;

a ring-shaped ball movement guider provided inside the housing for guiding movement of a bowling ball and confining the bowling ball within a limited surface treatment area, the ball movement guider having a ball reception opening having a diameter greater than a diameter of the bowling ball;

a surface treatment disc arranged below the ball movement guider for supporting, rotating and revolving the bowling ball, the surface treatment disc having a disc shaft and a surface treatment element for making frictional contact with the bowling ball to abrade or polish the bowling ball;

a disc rotating device for rotating the surface treatment disc about a disc center axis; and a disc revolving device for rotatably holding the disc shaft of the surface treatment disc and for causing the surface treatment disc to make revolving movement around a sun axis offset from the disc center axis, the sun axis being offset from a vertical center axis of the ball movement guider;

wherein when the surface treatment disc rotates and makes revolving movement around the sun axis as caused by the disc rotating device and the disc revolving device, the surface treatment disc rotates and revolve the bowling ball supported thereon, the movement of the bowling ball being further confined and changed by the ball movement guider so that the bowling ball makes frictional contact with the surface treatment element to abrade or polish the bowling ball.

10. The bowling ball surface treatment apparatus as recited in claim 9, wherein the ball movement guider has an inner surface formed of a curvilinear guide surface portion for guiding the bowling ball along a curved course of movement and a diverter portion for changing the course of movement of the bowling ball.

11. The bowling ball surface treatment apparatus as recited in claim 10, wherein the sun axis is arranged nearer to the diverter portion than to the curvilinear guide surface portion.

12. The bowling ball surface treatment apparatus as recited in claim 10, wherein the diverter portion is of a generally planar shape.

13. The bowling ball surface treatment apparatus as recited in claim 9, wherein the surface treatment element is formed of a surface treatment fabric and a cushion backing attached to the surface treatment fabric, the cushion backing having a central hard portion harder than the remaining portion of the cushion backing.

14. The bowling ball surface treatment apparatus as recited in claim 9, wherein the housing has an internal space divided into an upper surface treatment compartment and a lower drive compartment by means of a partition plate, the ball movement guider including a plurality of support members fixedly secured to the partition plate, each of the support members having a coil spring portion.

15. The bowling ball surface treatment apparatus as recited in claim 9, wherein the disc revolving device comprises a sun shaft rotatably mounted to the housing for rotation about the sun axis, a carrier arm attached to the sun shaft for rotatably supporting the disc shaft in a spaced-apart relationship with the sun shaft, and a driving mechanism for rotating the sun shaft to cause the revolving movement of the surface treatment disc.

16. The bowling ball surface treatment apparatus as recited in claim 9, wherein the revolving movement of the surface treatment disc causes the bowling ball to revolve around the vertical axis of the ball movement guider, the bowling ball being temporarily kept stationary when the bowling ball is pressed against the diverter portion of the ball movement guider.

17. The bowling ball surface treatment apparatus as recited in claim 9, wherein the bowling ball is rotated at increased or reduced spinning force as a result of the movements of the surface treatment disc and the movement of the bowling ball as confined and changed by the ball movement guider to cause the bowling ball makes frictional contact with the surface treatment element to abrade or polish the bowling ball.

* * * * *